US007467957B2

(12) United States Patent
Yuan et al.

(10) Patent No.: US 7,467,957 B2
(45) Date of Patent: Dec. 23, 2008

(54) ELECTRICAL CONNECTOR ASSEMBLY WITH PICK UP DEVICE

(75) Inventors: Wei Yuan, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/810,247

(22) Filed: Jun. 5, 2007

(65) Prior Publication Data

US 2007/0281546 A1 Dec. 6, 2007

(30) Foreign Application Priority Data

Jun. 5, 2006 (TW) ..... 95209725 U

(51) Int. Cl.
*H01R 13/44* (2006.01)

(52) U.S. Cl. ..... 439/135; 439/940

(58) Field of Classification Search ..... 439/41, 439/135, 477, 478, 479, 607, 940
See application file for complete search history.

(56) References Cited

U.S. PATENT DOCUMENTS 5,055,069 A * 10/1991 Townsend et al. ..... 439/608
5,199,886 A * 4/1993 Patterson ..... 439/79
5,340,320 A * 8/1994 Puerner ..... 439/79
5,354,207 A * 10/1994 Chikano ..... 439/79
6,383,024 B1 * 5/2002 Wang et al. ..... 439/607
6,733,302 B1 * 5/2004 Smalley et al. ..... 439/65
7,241,174 B2 * 7/2007 Tsai ..... 439/607

* cited by examiner

*Primary Examiner*—Thanh-Tam T Le
(74) *Attorney, Agent, or Firm*—Wei Te Chung

(57) ABSTRACT

An electrical connector assembly includes an electrical connector unit (11) to be mounted onto a printed circuit board (11), a supporting member for supporting the electrical connector unit, and a pick up device (12) attachable onto the electrical connector unit. The supporting member includes a supporting portion (112) extending from one side of the electrical connector unit, with the supporting portion defining a supporting surface (1121) resting on the printed circuit board. The pick up device includes a balance section (122) defining a balance surface (1221) extending parallel to the supporting surface such that when the pick up device is attached onto the printed circuit board, the balance surface of the pick up device is operable to be rested on the printed circuit board so as to counterbalance force torque caused by introduce of the supporting portion.

8 Claims, 3 Drawing Sheets

ELECTRICAL CONNECTOR ASSEMBLY WITH PICK UP DEVICE

BACKGROUND OF THE INVENTION

1. Field of the Invention

The present invention relates to the art of electrical connectors, and more particularly to an electrical connector assembly including a pick up device attached thereto.

2. Description of the Related Art

One conventional electrical connector assembly is shown in FIG. 3 to include an electrical connector unit 801 mounted onto a printed circuit board 81, and a supporting member for supporting the electrical connector unit 801. The supporting member includes a first supporting portion sandwiched between the electrical connector unit 801 and the printed circuit board 81, and a second supporting portion 802 arranged extending from one side of the electrical connector unit 801, with the second supporting portion 802 defining a supporting surface 8020 resting on the printed circuit board 81. Due to having the second supporting portion 802 at one side of the electrical connector unit 801, gravity center of the electrical connector unit 801 may be transferred to a portion of the electrical connector unit 801 where a multiply of terminals (not shown) are embedded, so that force torque M as indicated in FIG. 3 will be created as a result of causing flex of the electrical connector unit 801 with respect to the printed circuit board 81, and deflect of the terminals therein. This will result in the electrical connection failure between the electrical connector unit 801 and the printed circuit board 81 due to the deflectable terminals. Therefore, there is a need to provide a new electrical connector assembly to resolve the above-mentioned shortcoming. Thus, U.S. Pat. No. 7,121,885 having the same assignee with the instant application, discloses an auxiliary support attachable to the front mating port of the connector housing for balance the gravity thereof. The instant application is an improvement to such a design.

SUMMARY OF THE INVENTION

An electrical connector assembly according to an embodiment of the present invention includes an electrical connector unit to be mounted onto a printed circuit board, a supporting member for supporting the electrical connector unit, and a pick up device attachable onto the electrical connector unit. The supporting member includes a supporting portion extending from one side of the electrical connector unit, with the supporting portion defining a supporting surface resting on the printed circuit board. The pick up device includes a balance section extending from another side of the electrical connector unit. The balance section defines a balance surface extending parallel to the supporting surface such that when the pick up device is attached onto the printed circuit board, the balance surface of the pick up device is operable to be rested on the printed circuit board so as to counterbalance force torque caused by introduce of the supporting portion. Thus, no electrical connection failure will be generated between the electrical connector unit and the printed circuit board.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
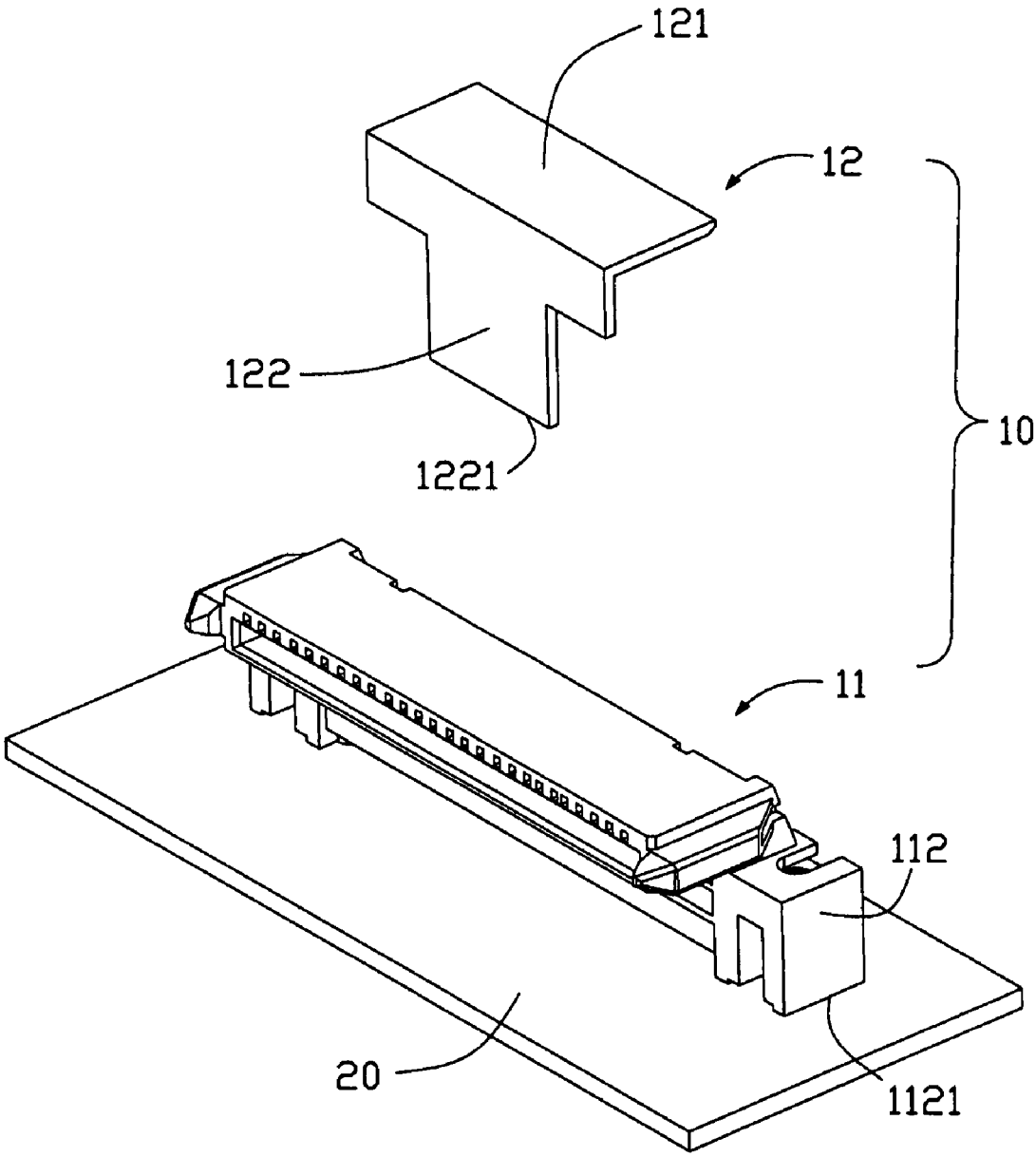
FIG. 1 is a partly-exploded, perspective view of an electrical connector assembly according to an embodiment of the present invention.
Figure 2:
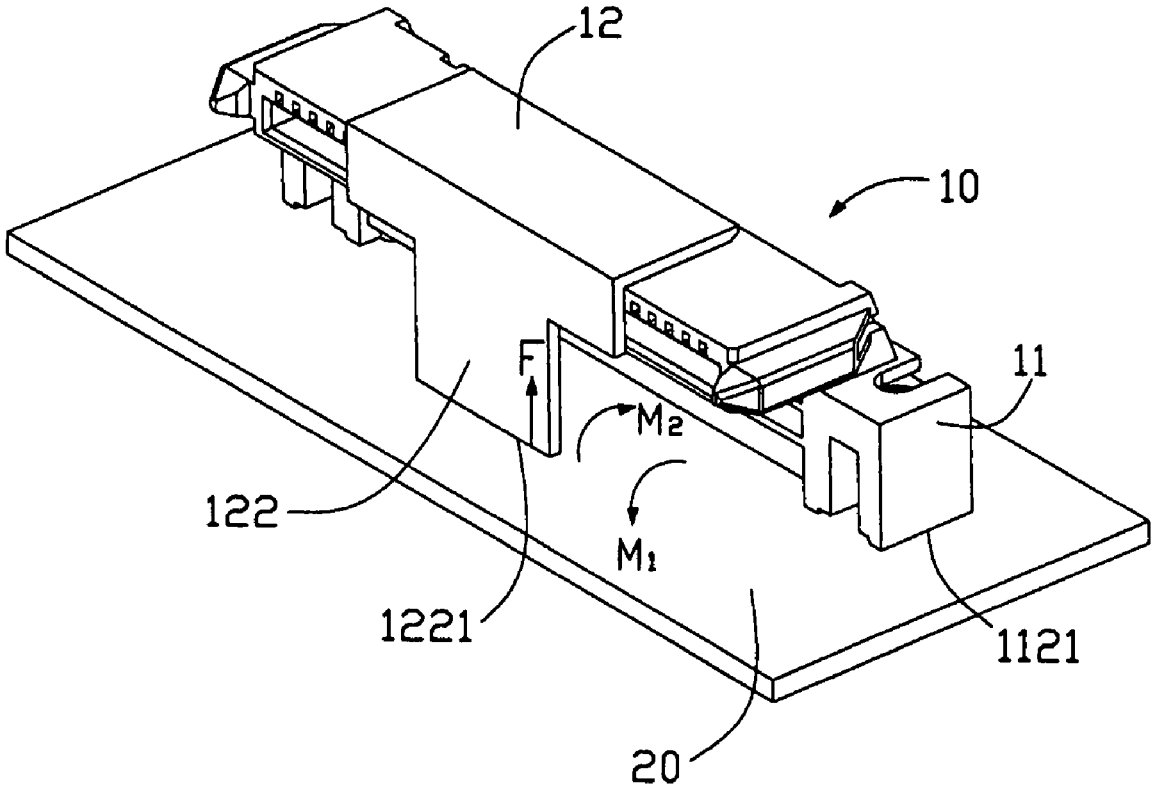
FIG. 2 is an assembled, perspective view of the electrical connector assembly of FIG. 1.
Figure 3:
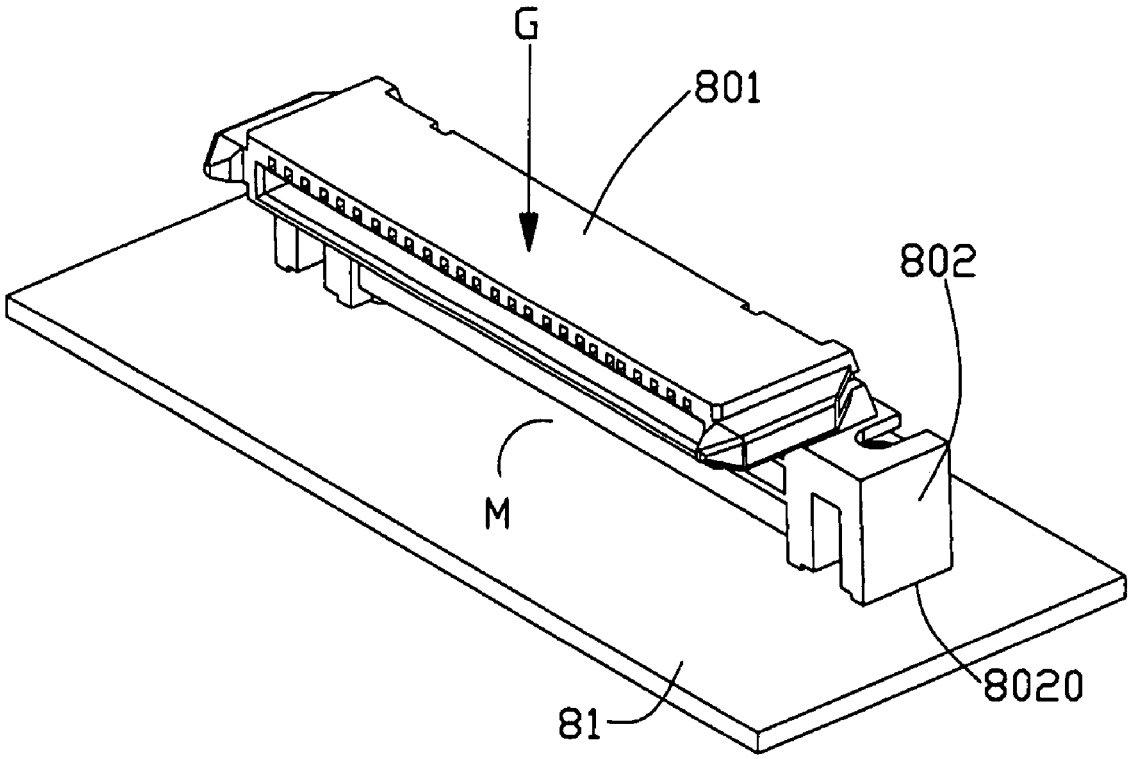
FIG. 3 (PRIOR ART)
FIG. 3 is a perspective view of a conventional electrical connector assembly.

Referring to FIGS. 1 and 2, an electrical connector assembly 10 is shown to include an electrical connector unit 11 to be mounted onto a printed circuit board 20, a supporting member 112 for supporting the electrical connector unit 11, and a pick up device 12 attached onto the electrical connector unit 11. The electrical connector unit 11 is defined as at least a part of an electrical connector, where a multiply of terminals (not shown) are embedded.

The supporting member includes a first supporting portion sandwiched between the electrical connector unit 11 and the printed circuit board 20, and a second supporting portion 112 arranged extending from one side of the electrical connector unit 11. The second supporting portion 112 defines a supporting surface 1121 resting on the printed circuit board 20. The electrical connector unit 11 is laterally offset with respect to the second supporting portion 112 in a transverse direction perpendicular to a length direction of the electrical connector unit 11.

The pick up device 12 includes a horizontal locating section 121 attached onto a top wall of the electrical connector unit 11, and a vertical balance section 122 extending downwardly from another side of the electrical connector unit 11 to be located adjacent a front wall of the electrical connector unit. The vertical balance section 122 defines a balance surface 1221 extending parallel to the supporting surface 1121, and is adjustable to be at a predetermined height with respect to the printed circuit board according to various embodiments, such that when the pick up device 12 is attached onto the printed circuit board 20, the balance surface 1221 of the pick up device 12 is operable to be rested on the printed circuit board 20 so as to counterbalance force torque $M_1$ caused by introduce of the second supporting portion 112 (see FIG. 2). This is so because the force torque $M_2$ generated by the engagement of the vertical balance section 122 and the printed circuit board 20 can be used to counteract the force torque $M_1$ caused by introduce of the second supporting portion 112. Thus, no force torque will be applied to the electrical connector unit so as to cause the damage of the terminals resulted from additional force torque, thereby having no electrical connection failure between the electrical connector unit 11 and the printed circuit board 20. It should be noted that in the instant invention, the vertical balance section 122 includes a horizontal retention tongue (not shown) extending backwardly from a back surface thereof for insertion into the mating slot of the connector housing, similar to what is disclosed in the aforementioned U.S. Pat. No. 7,121,885. Alternately, it may use a clamp hook formed on the rear edge of the horizontal locating section 121 to latchably engage the rear face of the housing for retaining the pick up device 12 to the connector housing.

In comparison with the aforementioned U.S. Pat. No. 7,121,885, in the preferred embodiment of the instant invention the horizontal locating section 121 of the pick up device is dimensioned with sufficiently large upper face for suction usage, under a condition that the connector 11 defines a first/full dimension along a front-to-back direction, i.e., from the front face of the connector housing to the rear face of the connector housing, and the horizontal locating section 121 of the pick up device 12 defines a second/partial dimension along the same front-to-back direction wherein the second dimension is around at least three fifths of the first dimension for suction stability consideration. On the other hand, the rear edge of the horizontal locating section 121 is located at a position where is positioned behind a front edge of the supporting portion 112.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly for mounting upon a printed circuit board, comprising:

an electrical connector unit mounted onto the printed circuit board;

a supporting member for supporting the electrical connector unit, the supporting member including a supporting portion extending from a first side of the electrical connector unit, the supporting portion defining a supporting surface adapted to be rested on the printed circuit board;

a pick up device attachable onto the electrical connector unit, the pick up device having a balance section extending from a second side of the electrical connector unit, the balance section defining a balance surface adapted to be rested on the printed circuit board, said balance surface disposed on center of the electrical connector unit such that when the pick up device is attached onto the printed circuit board, a first force torque generated by engagement of the balance surface of the pick up device and the printed circuit board is used to counterbalance a second force torque generated by engagement of the supporting portion and the printed circuit board;

the connector defines a first/full dimension along a side-to-side direction, which is measured from a front face of the housing to a rear face of the housing, and the pick up device defines a second/partial dimension along the same side-to-side direction, wherein the second dimension is around at least three fifths of the first dimension for suction stability consideration; wherein said pick up device is attached to a mating section of the housing at least by a horizontal locating section covering a top wall of the mating section; and wherein a vertical balance section linked to the horizontal locating section defines a T-shaped configuration for easy operability.

2. The electrical connector assembly as recited in claim 1, wherein the electrical connector unit is laterally offset with respect to the supporting portion in a transverse direction.

3. The electrical connector assembly as recited in claim 1, wherein the electrical connector unit has an elongated body defining a mating port opening at a front wall thereof.

4. An electrical connector assembly comprising:

a printed circuit board;

an electrical connector mounted on the printed circuit board and including an insulative housing defining a forwardly extending mating section and a pair of supporting portions at two ends; and a pick up device attached to the housing and including a horizontal locating section covering an upper face of the mating section under a condition that such horizontal locating section is dimensioned and configured to be cooperated a suction device for pick up usage of the connector, and a vertical balance section linked to the horizontal locating section and located on a center of the forwardly extending mating section, said vertical balance defining a balance surface at a bottom end abutting against the printed circuit board so that the pick up device has dual functions of suction usage and supporting usage;

a first force torque, generated by engagement of the balance surface of the pick up device and the printed circuit board is used to counterbalance a second force torque generated by engagement of the supporting portions and the printed circuit board; wherein the connector defines a first/full dimension along a side-to-side direction, which is measured from a front face of the housing to a rear face of the housing, and the horizontal locating section of the pick up device defines a second/partial dimension along the same side-to-side direction, wherein the second dimension is around at least three fifths of the first dimension for suction stability consideration; wherein said pick up device is attached to the mating section of the housing at least by the horizontal locating section covering a top wall of the mating section; and wherein the vertical balance section defines a T-shaped configuration for easy operability.

5. The electrical connector assembly as claimed in claim 4, wherein a rear edge of the horizontal locating section is located at a position where is positioned behind a front edge of the supporting portion for increasing suction stability.

6. The electrical connector assembly as claimed in claim 4, wherein the forwardly extending mating section is of being an elongated shape, and defines a mating port opening at a front wall thereof.

7. An electrical connector assembly for mounting upon a printed circuit board, comprising:

an electrical connector mounted on the printed circuit board and including insulative housing defining a forwardly extending mating section and at least one supporting portion essentially located behind the mating section along a side to side direction; and a pick up device attached to the housing and including a horizontal locating section covering an upper face of the mating section under a condition that such horizontal locating section is dimensioned and configured to be cooperated a suction device for pick up usage of the connector, and a vertical balance section linked to the horizontal locating section and located forwardly from the mating section along said front-to-back direction, said vertical balance section defining a balance surface at a bottom end for abutting against the printed circuit board so that the pick up device has dual functions of suction usage and supporting usage;

a first force torque, generated by engagement of the balance surface of the pick up device and the printed circuit board is used to counterbalance a second force torque generated by engagement of the supporting portions and the printed circuit board; wherein the connector defines a first/full dimension along the side-to-side direction, which is measured from a front face of the housing to a rear face of the housing, and the horizontal locating section of the pick up device defines a second/partial dimension along the same side-to-side direction, wherein the second dimension is around at least three fifths of the first dimension for suction stability consideration; wherein said pick up device is attached to the mating section of the housing at least by the horizontal locating section covering a top wall of the mating section; and wherein the vertical balance section defines a T-shaped configuration for easy operability.

8. The electrical connector assembly as claimed in claim 7, wherein the forwardly extending mating section is of being an elongated shape, and defines a mating port opening at a front wall thereof.

* * * * *